US005163646A

United States Patent [19]

Engelhardt

[11] Patent Number: 5,163,646

[45] Date of Patent: Nov. 17, 1992

[54] WRIST SUPPORT ARRANGEMENT FOR USE WITH STAND-ALONE KEYBOARD

[76] Inventor: Bernard Engelhardt, 51 Abbeywood Trail, Don Mills, Ontario, Canada, M3B 3B4

[21] Appl. No.: 584,349

[22] Filed: Sep. 18, 1990

[51] Int. Cl.[5] ..... B68G 5/00

[52] U.S. Cl. ..... 248/118; 400/715

[58] Field of Search ..... 248/118, 118.1, 118.3, 248/118.5, 917, 918; 400/715; 211/69.1

[56] References Cited

U.S. PATENT DOCUMENTS

| | | | |
|---|---|---|---|
| 3,300,250 | 1/1967 | Dollgener et al. | 248/118 X |
| 4,481,556 | 11/1984 | Berke et al. | 248/118 X |
| 4,482,063 | 11/1984 | Berke et al. | 248/118 X |
| 4,482,064 | 11/1984 | Berke et al. | 248/118 X |
| 4,545,554 | 10/1985 | Latino et al. | 248/118.1 |
| 4,570,803 | 2/1986 | Peterson | 248/118 X |
| 4,621,781 | 11/1986 | Springer | 248/118 |
| 4,688,862 | 8/1987 | Fowler et al. | 248/118.5 |
| 4,913,390 | 4/1990 | Berke | 248/176 |

*Primary Examiner*—Ramon O. Ramirez

[57] ABSTRACT

An elongated resilient pad is removably mounted in an elongated structure and is removably retained on the bottom surface of the structure. A portion for underlying the keyboard extends from the bottom surface along one edge of the structure and in the same plane as the bottom surface. The resilient pad is covered with a soft, absorbent, washable material and the cover encases a washable, foam material. The resilient pad may be a water-filled pouch which is also covered with a soft, absorbent, washable material.

24 Claims, 2 Drawing Sheets

WRIST SUPPORT ARRANGEMENT FOR USE WITH STAND-ALONE KEYBOARD

BACKGROUND OF INVENTION

1. Field of the Invention

The invention relates to a wrist support arrangement for use in association with stand-alone keyboards. More specifically, the invention relates to such an arrangement which includes a removable resilient pad covered with an absorbent washable material.

2. Description of Prior Art

Wrist and/or hand rest and support arrangements for use in association with stand-alone keyboards, that is, keyboards which are connected to computers, wordprocessors, etc., by only an electric wire so that they can be located on different levels or different locations, from the computers, wordprocessors, etc., are known in the art as illustrated in, for example, U.S. Pat. No. 4,913,390, Berke Apr. 3, 1990, U.S. Pat. No. 4,545,554, Crabbe et al, Oct. 8, 1985, U.S. Pat. No. 4,482,064, Berke et al, Nov. 13, 1984, U.S. Pat. No. 4,482,063, Berke et al, Nov. 13, 1984, and U.S. Pat. No. 4,481,556, Berke et al, Nov. 6, 1984.

The '390 patent teaches such a support which can be adjusted to be tailored to an individual operator, keyboard or the like. The '554 patent teaches a wrist support having means for adjusting the height thereof.

The computer terminal support and hand rest as taught in the '064 patent includes a conductive portion for draining static charges from the computer terminal operator. The '063 patent also teaches a conductive portion for draining static charges from the computer terminal operator. In addition, it includes a trough into which the fingers of the computer operator may be placed during rest intervals. The trough may also function as a receptacle for pens, pencils and the like.

The '556 patent also includes a conductive portion for draining static charge from the computer terminal operator and it also includes a trough in which the fingers of the computer operator may be placed during rest intervals. Once again, the trough may also be used as a receptacle for pens, pencils and the like.

Although all of the above hand/wrist supports include different mechanical features, none of them are designed in accordance with ergonometric standards as described in, for example, PEOPLE AND PRODUCTIVITY: A MANAGER'S GUIDE TO ERGONOMICS IN THE ELECTRONICS OFFICE, Dainoff, Marvin J., published by Holt, Rinehart and Winston of Canada, Limited, 1986 which states, at Chapter 4, page 66, "The use of an adjustable wrist or palm support in front of the keyboard can be a key element. However, this piece of equipment, which is typically the least expensive in the whole system, must be chosen with care. The underside of the wrist is very sensitive, and if the support is hard or sharp, like the edge of the table or desk, it may do more harm than good. The wrist rest should be padded; the parts that come in contact with the wrist should not be cold (and therefore uncomfortable) to the touch. If a proper support is provided for the wrist and the forearm, this will probably overcome any increased load due to the increased forearm ahgle imposed by larger keyboard angles".

Although desirable features are described in Dainoff, he does not provide any instructions for a physical structure to incorporate these features.

SUMMARY OF INVENTION

It is therefore an object of the invention to provide a wrist support arrangement for use in association with stand-alone keyboards.

It is a more specific object of the invention to provide such an arrangement which includes a resilient pad.

It is an even more specific object of the invention to provide such an arrangement wherein the resilient pad is removably mounted in the arrangement.

It is an even more specific object of the invention to provide such an arrangement wherein the pad includes a covering of a soft, absorbent and washable material.

In accordance with the invention there is provided a wrist support arrangement for use with a stand-alone keyboard, comprising:

an elongated resilient pad;

an elongated structure, having a bottom surface, for removably mounting said pad, said structure including pad retaining means for removably retaining said pad on said bottom surface of said structure; and means for maintaining said elongated structure in fixed relationship with said keyboard.

BRIEF DESCRIPTION OF DRAWINGS

The invention will be better understood by an examination of the following disclosure, together with the accompanying drawings, in which.

DESCRIPTION OF PREFERRED EMBODIMENTS

Figure 1:
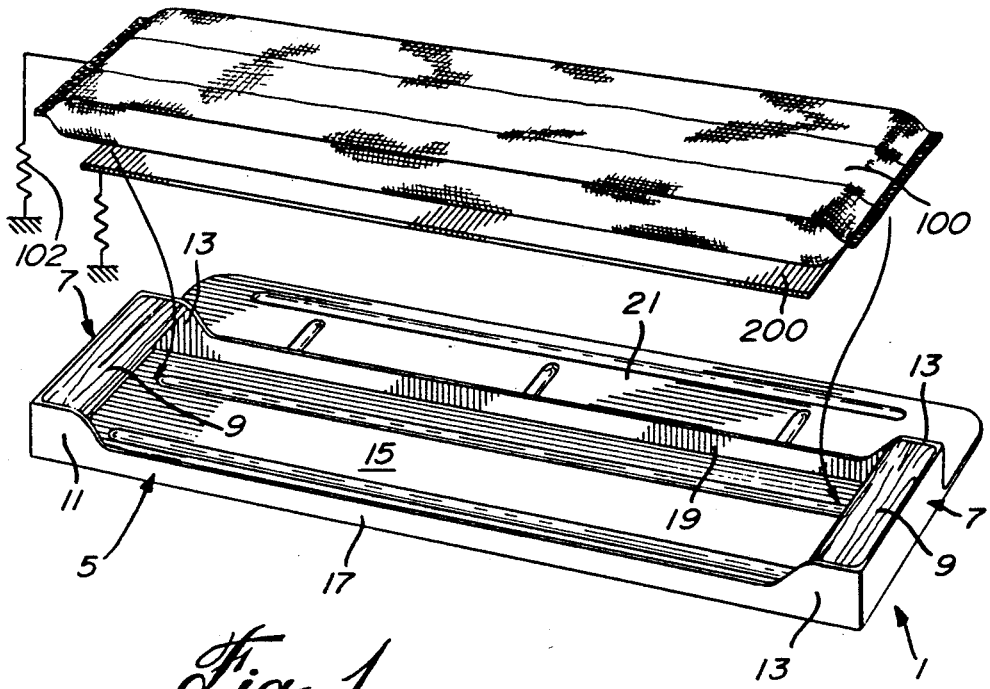
FIG. 1 is an exploded perspective view of a preferred embodiment of the invention.
Figure 2:
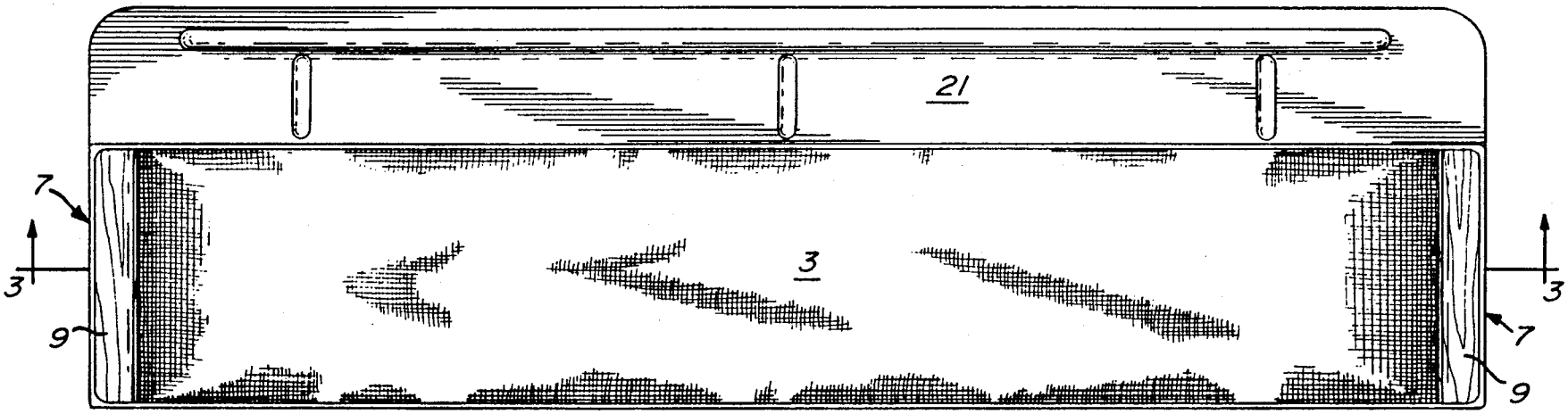
FIG. 2 is a top view of FIG. 1.
Figure 3:
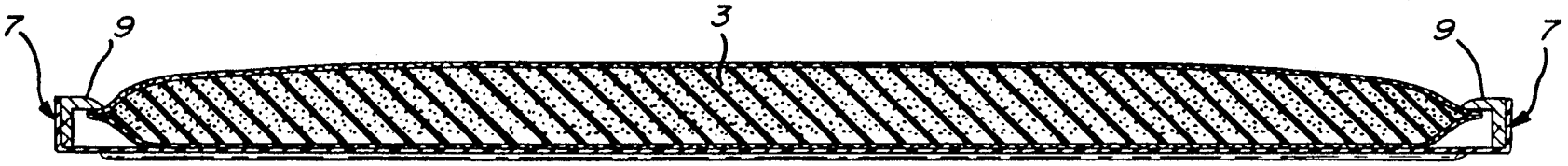
FIG. 3 is a section through III—III of FIG. 2.

Referring to FIGS. 1 to 3, the arrangement, illustrated generally at 1, comprises an elongated resilient pad 3, and an elongated structure 5 for removably mounting the resilient pad. The structure includes means 7, at either end thereof, for removably retaining the resilient pad 3, as best illustrated in FIG. 3. In the illustrated embodiment, the means for removably retaining includes a step 9 and side walls 11 and 13. The step 9 will prevent the pad from moving in a vertically upward direction, while the side walls 11 and 13 prevent lateral movement of the resilient pad.

The structure also includes a bottom surface 15 and two shorter side walls 17 and 19 extending upwardly and at right angles to the bottom surface 15.

Figure 4:
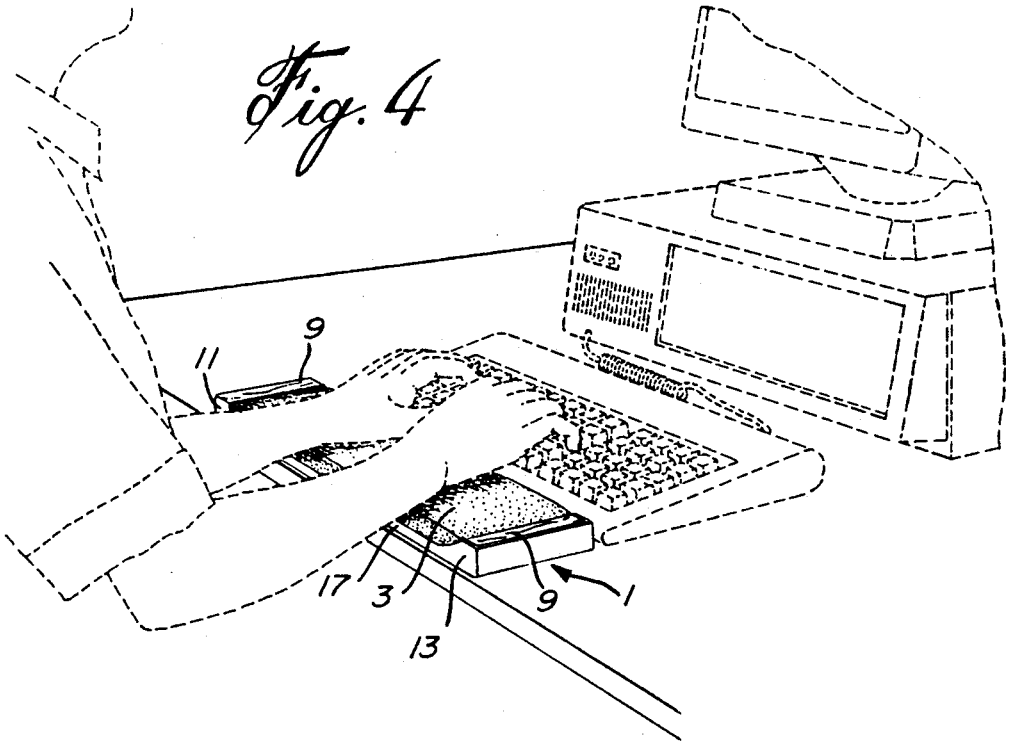
FIG. 4 is a perspective view of the arrangement in use with a stand-alone keyboard.

As can be seen, the structure 5 is somewhat box-like in shape. The structure also includes means for maintaining the elongated structure in fixed relationship with the keyboard. In the illustrated embodiment, this comprises a portion 21 extending from the bottom surface 15 along one edge of the structure 5. The portion 21 would underlie the keyboard as shown in FIG. 4. Portion 21 extends in the same plane as bottom surface 15. Other means, such as slats extending from the end walls of structure 5, could be used for this purpose.

In order to meet the ergonometric requirements, the resilient pad includes an outer cover made of a soft, absorbent and easily washable fibrous yarn material such as, for example, a cotton or cotton-like cloth material or a knit or woven textile material. Encased inside the cover is a resilient and easily washable material such as foam or the like. Thus, the entire resilient pad can be removed from the arrangement and washed or replaced with a new resilient pad when the old pad is worn out.

To provide a static discharge path, a conductive thread 100 can be knit or woven into the material of the outer cover. One end of thread 100 would then be connected to a primary power ground, as found in a wall outlet, through current limiting resistor 102. Alternatively, a metal plate can underlie the pad, and the plate can be connected to ground.

The resilient pad 3 can, instead, be made of a foam material which is electrostatically flocked to provide a soft velvety finish so that a separate outer cover is not required.

As seen in FIG. 4, the top of the pad is high enough so that the wrist of an operator will rest naturally on the pad while the operator is using the keyboard. Because of the nature of the materials of the pad, the outer surface of the pad will remain warm and soft to the touch. In addition, there are no hard or sharp parts to the resilient pad, so that the underside of the wrist will not engage any hard or sharp parts or edges.

In an alternative embodiment, the resilient pad would comprise a water-filled pouch. The pouch would be constructed of a first, inner, water-impermeable layer so that the water in the interior of the pouch would be retained within the pouch. The impermeable layer would then be covered by an outer layer made of a soft, absorbent, washable material such as, for example, the cotton cloth above-mentioned. Once again, the water-filled pouch is soft and warm to the touch and does not include any hard parts or sharp edges to engage the underside of the wrist.

In this regard, it is noted that the short walls 17 and 19 are low enough so that, even when the resilient pad is compressed, the top surface of the resilient pad will still be above the top surface of the walls 17 and 19. Thus, even when the resilient pad is compressed, the underside of the wrist or arm will not contact the top surface of the hard wall.

Although several embodiments have been described, this was for the purpose of illustrating, but not limiting, the invention. Various modifications, which will come readily to the mind of one skilled in the art, are within the scope of the invention as defined in the appended claims.

I claim:

1. A wrist support arrangement for use with a stand-alone keyboard, comprising:

an elongated resilient pad;

an elongated structure, having a bottom surface, for removably mounting said pad, said structure including pad retaining means for removably retaining said pad on said bottom surface of said structure, said retaining means being spaced from said bottom surface and overlying a portion of said resilient pad when said resilient pad is mounted in said elongated structure, wherein unaided movement of said resilient pad away from said bottom surface is prevented by said retaining means; and means for maintaining said elongated structure in fixed relationship with said keyboard.

2. An arrangement as defined in claim 1 wherein said elongated structure comprises a rectangular box-like structure having a bottom wall, two end walls and two side walls, said end walls and side walls all being of the same height, an open top defined by the top edges of said end walls and said side walls;

said retaining means comprising a first member extending from one of said side walls to the other one of said side walls and disposed at one end of said boxlike structure and a second member extending from said one side wall to said other one of said side walls at the other end of said structure.

3. An arrangement as defined in claim 2 wherein said resilient pad includes a cover, said cover comprising a soft, absorbent, washable material.

4. An arrangement as defined in claim 3 wherein said material comprises a cotton cloth material.

5. An arrangement as defined in claim 1 wherein said resilient pad comprises a water-filled pouch.

6. An arrangement as defined in claim 5 wherein said water-filled pouch has a cover, said cover comprising a first, inner, water-impermeable layer, and a second, outer, layer covering said first layer, said second layer being made of a soft, absorbent, washable material.

7. An arrangement as defined in claim 6 wherein said material of said second layer is a cotton cloth material.

8. An arrangement as defined in claim 3 wherein said means for maintaining comprises a portion for underlying said keyboard, said portion extending from said bottom surface of said elongated structure along an edge thereof and in the same plane as said bottom surface.

9. An arrangement as defined in claim 1 wherein said resilient pad comprises a flocked foam material.

10. An arrangement as defined in claim 1 and further including a static discharge path, said path comprising a conductive thread knit or woven into said material, one end of said thread being connected to a primary power ground.

11. An arrangement as defined in claim 3 wherein said material comprises a knit material.

12. An arrangement as defined in claim 3 wherein said material comprises a woven material.

13. A wrist support arrangement for use with a stand-alone keyboard, comprising:

an elongated resilient pad;

an elongated structure, having a bottom surface, for removably mounting said pad, said structure including pad retaining means for removably retaining said pad on said bottom surface of said structure; and means for maintaining said elongated structure in fixed relationship with said keyboard;

said means for maintaining comprising a portion for underlying said keyboard;

said portion extending from said bottom surface of said elongated structure along an edge thereof and in the same plane as said bottom surface.

14. An arrangement as defined in claim 13 wherein said resilient pad includes a cover, said cover comprising a soft, absorbent, washable material.

15. An arrangement as defined in claim 14 wherein said material comprises a cotton cloth material.

16. An arrangement as defined in claim 15 wherein said material comprises a knit material.

17. An arrangement as defined in claim 16 wherein said material comprises a woven material.

18. An arrangement as defined in any one of claims 15, 16, or 17 wherein said resilient pad comprises a washable foam material encased in said cover.

19. An arrangement as defined in claim 13 wherein said resilient pad comprises a water-filled pouch.

20. An arrangement as defined in claim 19 wherein said water-filled pouch has a cover, said cover comprising a first, inner, water-impermeable layer, and a second, outer, layer covering said first layer, said second layer being made of a soft, absorbent, washable material.

21. An arrangement as defined in claim 20 wherein said material of said second layer is a cotton cloth material.

22. An arrangement as defined in claim 13 wherein said resilient pad comprises a flocked foam material.

23. An arrangement as defined in claim 13 and further including a static discharge path, said path comprising a conductive thread knit or woven into said material, one end of said thread being connected to a primary power ground.

24. An arrangement as defined in claim 11 or 13 wherein said resilient pad comprises a washable foam material encased in said cover.

* * * * *